United States Patent [19]

Swanson

[11] 4,454,867

[45] Jun. 19, 1984

[54] THERAPEUTIC CHAIR ASSEMBLY

[76] Inventor: Russell K. Swanson, 3212 Coleman Rd., Kansas City, Mo. 64111

[21] Appl. No.: 486,931

[22] Filed: Apr. 20, 1983

[51] Int. Cl.[3] ..... A61H 15/00

[52] U.S. Cl. ..... 128/57; 128/33; 128/45

[58] Field of Search ..... 128/33, 45, 47, 49, 128/56, 57; 403/121, 122

[56] References Cited

U.S. PATENT DOCUMENTS

| | | | |
|---|---|---|---|
| 340,533 | 4/1886 | Worthmeyer | 128/57 |
| 857,761 | 6/1907 | Schmidt | 128/57 |
| 942,976 | 12/1909 | Reach | 128/57 |
| 1,070,924 | 8/1913 | Schulze | 128/57 |
| 1,609,796 | 12/1926 | Cheney | 128/56 |
| 2,258,931 | 10/1941 | Heer et al. | 128/57 |
| 3,095,874 | 7/1963 | Frajdenrajch | 128/57 |

*Primary Examiner*—Richard J. Apley
*Assistant Examiner*—David J. Brown
*Attorney, Agent, or Firm*—Schmidt, Johnson, Hovey & Williams

[57] ABSTRACT

An improved therapeutic chair is provided which advantageously massages the muscles of the back of a user in a number of directions while conforming to the curvature of the user's back, thereby greatly enhancing the therapeutic value of the chair. Preferably, the back support of the chair includes a plurality of spaced-apart massaging devices located adjacent the back of a user when the user is seated in the chair. Each massaging device includes a plurality of elongated rollers interconnected in a radial, outwardly extending fan-like fashion about an elongated shaft. The rollers are pivotally mounted and forwardly biased such that, in use, the rollers exert a slight pressure on the musculature of the back while the pivotal mounting allows the rollers to conform to the curvature of the back. An electrical motor powers the massaging device thereby rotating the shaft and roller arrangement to provide the massaging action. In particularly preferred forms, the massaging devices are reciprocated up and down within the chair while the fan-like roller arrangement revolves thereby imparting a variable massaging action to the musculature of the back.

7 Claims, 5 Drawing Figures

Fig. 1
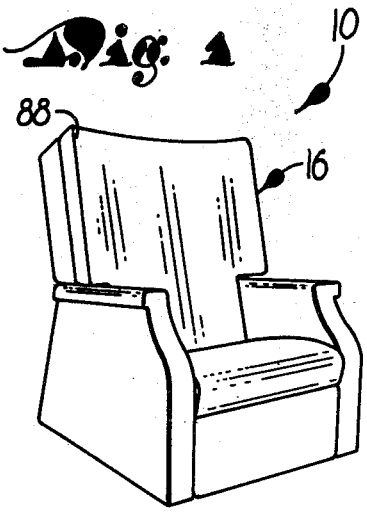
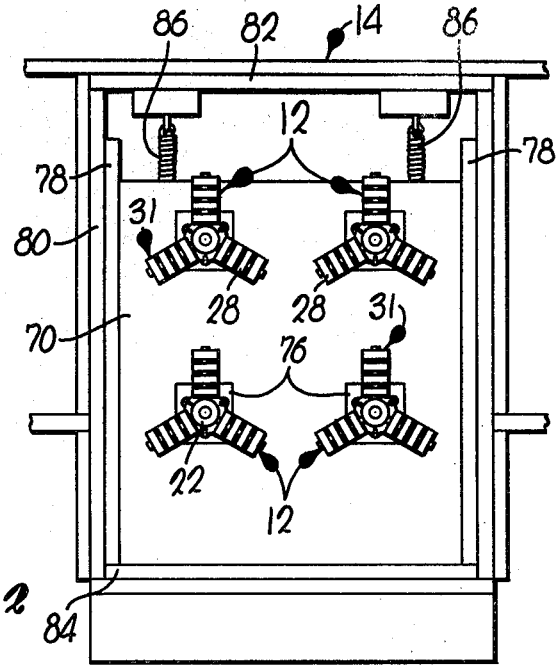
Fig. 2
Fig. 3
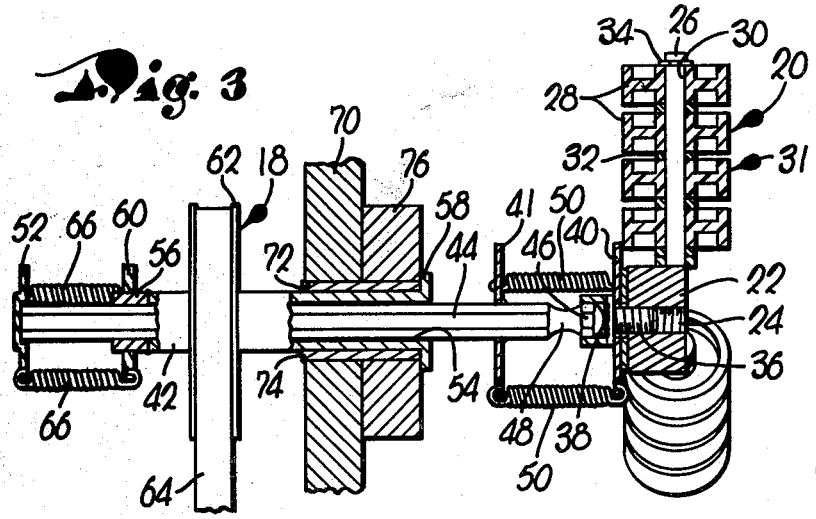
Fig. 5
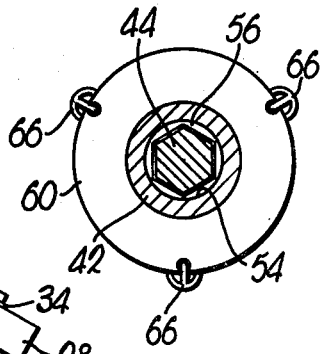
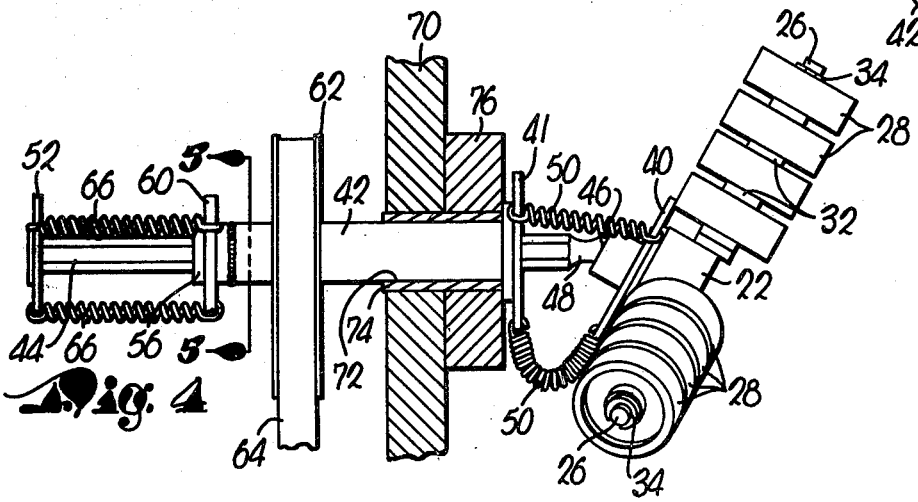
Fig. 4

THERAPEUTIC CHAIR ASSEMBLY

BACKGROUND OF THE INVENTION

1. Field of the Invention

This invention relates to a therapeutic chair assembly which is highly effective in imparting a variable massaging action to the musculature of the back of a user. More particularly, it is concerned with a plurality of massaging devices located in the back support of a chair, with each device presenting a plurality of rollers arranged in a radial, fan-like fashion. The devices are rotatingly driven such that the rollers impart a variable massage to the back of a chair.

2. Description of the Prior Art

Therapeutic chairs for massaging the musculature of the back have enjoyed widespread use particularly among that segment of the population afflicted with back ailments. Heretofore, such chairs have generally comprised a back support having a plurality of generally parallel, spaced-apart, elongated cylinders motivated to revolve about their respective longitudinal axis. Typically, the cylinders are mounted transverse to the user's back and the mounting is reciprocated up and down within the back support of the chair. While this up and down action of revolving cylinders upon the muscles of the back has some therapeutic value, it has been found that this kneading action is applied principally to the muscles in only an up and down direction. Thus, such prior therapeutic chairs apply a somewhat limited massaging action to the muscles of the back.

SUMMARY OF THE INVENTION

The limited therapeutic value found in past massaging chairs as outlined above is in large measure rectified by the therapeutic chair assembly in accordance with the present invention. Thus, the chair hereof presents a massaging device which kneads the musculature of the back in a multiplicity of directions, thereby greatly enhancing the therapeutic benefits derived from such a chair.

The therapeutic chair hereof presenting a massaging device in accordance with the present invention, broadly includes an elongated shaft, with one or more outwardly-extending, radiallyoriented elongated arms mounted adjacent one end of the shaft, a massage element rotatably carried on each arm, and means for axially revolving the shaft thereby activating the therapeutic action. Preferably, a plurality of arms are arranged in a radial, fan-like fashion and operably coupled to the shaft such that axial rotation of the shaft affects corresponding rotation of the arms. The arms normally lie in a reference plane transverse relative to the longitudinal axis of the shaft. The arms are pivotally mounted to the shaft for limited pivoting movement of the arms out of the plane, thereby allowing the arms to conform to the curvature of the back. Advantageously, the device includes structure forwardly biasing the arms towards the user's back, thereby enhancing the massaging action.

In particularly preferred forms, the therapeutic chair incorporates a plurality of spaced-apart massaging devices, each device having a plurality of radially-oriented arms arranged in an outwardly extending fashion from an elongated shaft. Each device preferably includes an elongated journal having an elongated, longitudinally-oriented, polygonal in cross-section, passageway extending therethrough. The elongated shaft has a polygonal cross-section and is slidably received through the passageway such that axial rotation of the journal affects corresponding axial rotation of the shaft. Advantageously, the arms are centrally joined by a hub which is pivotally connected to one end of the shaft by means of a ball and socket type arrangement. Additionally, the shaft is forwardly biased towards the massage arms and each arm includes a plurality of annular rollers rotatably mounted thereon. This forward biasing and pivotal coupling allows the arms to apply pressure to the musculature of a user's back while at the same time allowing the rollers to conform to the curvature of the user's back.

BRIEF DESCRIPTION OF THE DRAWINGS

FIG. 1 is a perspective view of a therapeutic chair incorporating the massage device of the present invention;

FIG. 2 is a front elevational view of four massaging devices mounted to a support structure, with the support structure located in the back of the chair illustrated in FIG. 1;

FIG. 3 is a partial, vertical sectional view of a massage device in accordance with the present invention;

FIG. 4 is a side elevational view of the massaging device of the present invention with the support structure partially broken away to illustrate more detail; and FIG. 5 is a sectional view taken along line 5—5 of FIG. 4.

DESCRIPTION OF THE PREFERRED EMBODIMENT

Referring now to the drawing, a therapeutic chair 10 is illustrated and includes a plurality of massaging devices 12 in accordance with the present invention. The devices 12 are mounted in spaced adjacency to one another in a support structure 14, with the structure 14 located in the back 16 of the chair 10. Each massage device 12 generally includes a elongated, rotatable assembly 18 and a kneading unit 20 affixed adjacent one end of the assembly 18.

In more detail each kneading unit 20 includes a cylindrically-shaped hub 22 having a threaded aperture 24 extending axially therethrough. Three elongated, cylindrical in cross-section pins 26 are radially affixed (as by welding) to the hub 22 in a spaced relationship (approximately 60° apart). Four cylindrically-shaped wheels 28, each centrally apertured as at 30 are rotatably received around each pin 26 thereby completing the arm assembly 31 (see FIG. 3). Advantageously, spacer washers 32 are intermittently disposed between the hub 22 and respective wheels 28, with the wheels 28 and washers 32 retained on pin 26 by a U-shaped retainer clip 34. An elongated shank 36 is threadingly secured in aperture 24 and includes structure defining a hexagonal in cross-section socket 38 on one end thereof. Secured in between the socket 38 and the hub 22 is an enlarged washer 40 for purposes which will be made clear.

Assembly 18 broadly includes an elongated, cylindrically-shaped journal 42 and an elongated, hexagonal in cross-section shaft 44. One end of the shaft 44 has a hexagonal in cross-section ball 46 complementally dimensioned for operable reception within socket 38 of unit 20. Immediately adjacent the hexagonal outer surface of the ball 46 is a necked-down, concave surface 48. An enlarged washer 41 is transversely affixed to the shaft 44 (as by welding). Three conventional coiled springs 50 are affixed between the respective washers 40 and 41. Another enlarged washer 52 is affixed to the distal end of shaft 44 remote from the ball 46, with the washer 52 very similar in configuration and purpose to the washers 40, 41.

The elongated journal 42 contains an elongated passageway 54 longitudinally extending therethrough. The passageway 54 presents a hexagonal in cross-section constriction as at 56. One end of the journal 42 presents an enlarged, outwardly extending shoulder 58, while, an enlarged washer 60 is transversely secured to journal 42 adjacent the end opposite shoulder 58. Interposed between shoulder 58 and washer 60 is an enlarged pulley 62 transversely affixed to the journal 42, with the pulley 62 operably configured for the reception of V-belt 64. As seen in FIGS. 3–4, the shaft 44 is slidingly received in passageway 54 of journal 42. The shaft 44 is forwardly biased toward socket 38 by the coil springs 66 interconnecting the respective washers 52, 60.

As seen in FIGS. 2–3, the support structure 14 includes a flattened, rectangularly-shaped board 70 apertured as at 72 for the rotatable reception of journal 42 of each massage device 12. To this end, each aperture 72 contains a circular bushing 74 enveloping the respective journal 42. Advantageously, an apertured, flattened, spacer board 76 is interposed between board 70 and the respective shoulder 58 of journal 42. The board 70 is mounted in support structure 14 by way of a pair of elongated channels 78 slidingly receiving the side margins of the board 70. The channels 78 are secured within a rectangularly-shaped frame 80 as seen in FIG. 2. With the board 70 received in between channels 78, the board 70 is slidable toward and away from the top 82 and bottom 84 of the frame 80. To this end, a pair of elongated, coil springs 86 interconnect the board 70 and top 82 thereby upwardly biasing the board 70 towards the top 82. Preferably, a reciprocating apparatus (not shown) is included to slidably motivate the board 70 within the channels 78. Such apparatus might include a motor, suitably linked to the board 70, for slidably reciprocating the board 70 toward and away from the top 82 and bottom 84 respectively of the frame 80. As may be appreciated, the completed support structure 14 is enveloped in a sheet-like, flexible covering 88 and included in the back 16 of the chair 10 (see FIG. 1).

In use, the massaging devices 12 are actuated by an electric motive force (not shown) which rotates pulley 62 via V-belt 64. This axial rotation of the pulley is imparted to the journal 42, thereby revolving the journal 42 within the bushing 74. As seen in FIGS. 3, 5, axial rotation of the journal 42 is imparted to the shaft 44 through the driving engagement of constriction 56 and the hexagonal surface of the shaft 44. The ball 46 and socket 38 interconnection in turn imparts an axial rotation to the hub 22 and correspondingly rotates the arm assembly 31. The wheels 28 freely rotate about the respective pins 26 as the hub 22 rotates. As may be appreciated, the wheels 28 are positioned to contact the covering 88 of the chair 10.

As best seen in FIG. 4, this operable reception of the shaft 44 within journal 42 greatly enhances the therapeutic capability of massage devices 12. Thus, the springs 66 forwardly bias the massage devices 12 (left to right as seen in FIG. 4) to apply a yieldable amount of pressure with the kneading units 20 adjoining a user's back. Additionally, the springs 50 retain the ball and socket interconnection between the shaft 44 and kneading unit 20, but allows the kneading unit 20 to pivot about the longitudinal axis of the shaft 44 without losing the driving interconnection between the shaft 44 and hub 22. As seen in FIG. 3, the arms 31 of unit 20 normally lie within a reference plane transverse to the longitudinal axis of shaft 44. However, as illustrated in FIG. 4, the ball and socket interconnection allows the arms to pivot out of the reference plane. Thus, the ball and socket interconnection allows the kneading unit 20 to conform to the curvature of a user's back.

Although the rotation of the device 12 applies an adequate massage, it has been found that the therapeutic value is enhanced if the devices 12 are simultaneously moved up and down the user's back while the devices 12 rotate. Therefore, when desired by the user, another motive means such as the aforementioned motor is actuated to alternatingly reciprocate the board 70 within the channels 78 toward and away from the top and bottom 82, 84 respectively. With the board 70 reciprocating and the massage units 20 revolving (see FIG. 2) the back of a user is subjected to the massaging pressure of the wheels 28 in a variety of different directions. Thus, the musculature of the back of a user is massaged in a multitude of different directions, greatly enhancing the therapeutic value of the chair 10 in accordance with the present invention.

I claim:

1. A massage device comprising:

an elongated shaft;

at least one elongated arm, said arm normally lying in a reference plane transverse to the longitudinal axis of the shaft;

means mounting said arm adjacent one end of said shaft in an outwardly extending relationship to said shaft, said means including structure for limited pivoting movement of said arm out of said reference plane and a mounting hub having a first end adjacent said outwardly extending arm and a second end presenting structure defining a polygonal in cross-section socket, said shaft including an elongated axle having a polygonal in cross-section ball complemental with said socket, said ball being received in said socket for simultaneous rotation of said shaft and hub and for said limited pivoting movement of said arm;

a massage element rotatably carried on said arm; and means for axially rotating said shaft to effect corresponding rotation of said arm.

2. A massage device as set forth in claim 1, said massage element comprising a plurality of annular rollers rotatably mounted on the arm.

3. A massage device as set forth in claim 1, said shaft including resilient means operably secured to said arm for biasing the same to the normal position thereof.

4. A massage device as set forth in claim 3, said biasing means comprising resilient spring means operably coupled with said arm.

5. A massage device as set forth in claim 1, said shaft being polygonal in cross-section for a portion thereof, said rotating means including an elongated, axially rotatable, tubular journal having structure defining an elongated, polygonal passageway therethrough complemental with said shaft portion, said shaft portion being received in said passageway for simultaneous axial rotation of said journal and shaft and for longitudinal sliding movement of said shaft relative to said journal.

6. A massage device as set forth in claim 5, said shaft normally slidingly received in said journal in a reference position, and said device including resilient biasing means operably interconnecting said journal and said shaft for biasing said shaft to said normal position.

7. In a furniture piece having a flexible support, presenting a body supporting surface and an opposed face, a therapeutic assembly comprising:

a plurality of spaced-apart massage devices, each comprising:

an elongated shaft oriented generally transverse to said body-supporting surface;

an elongated kneading unit including a plurality of rollers;

means mounting said unit adjacent one end of said shaft in an outwardly-extending, transverse orientation relative to said shaft, said mounting means including a mounting hub having a first end adjacent said kneading unit and a second end presenting structure defining a socket, said shaft carrying a ball complemental with said socket, said ball being received in said socket for simultaneous rotation of said shaft and hub, and also including structure for permitting limited pivoting movement of said kneading unit with respect to said shaft;

means for axially rotating said shaft for effecting corresponding rotation of said unit; and structure mounting said massage devices for engagement of said rollers with said opposed face of said body-supporting surface.

* * * * *